US005465648A

United States Patent [19]

Cy

[11] Patent Number: 5,465,648

[45] Date of Patent: Nov. 14, 1995

[54] CYLINDER HAVING A PISTON ASSEMBLY CAPABLE OF STOPPING ONCE WHEN HAVING MOVED UP AND DOWN EVERY TIME

[76] Inventor: Chiou C. Cy, P.O. Box 82-144, Taipei, Taiwan

[21] Appl. No.: 368,369

[22] Filed: Jan. 4, 1995

[51] Int. Cl.[6] ..... F01B 9/00

[52] U.S. Cl. ..... 92/140; 92/146; 123/197.4; 74/52

[58] Field of Search ..... 92/140, 169.1, 92/146; 74/50, 63, 68, 69, 52; 403/381; 123/48 R, 197.4, 78, 78 BA, 78 F

[56] References Cited

U.S. PATENT DOCUMENTS

| | | | |
|---|---|---|---|
| 2,506,693 | 5/1950 | Voisin | 74/52 |
| 3,433,083 | 3/1969 | Pope | 74/68 |
| 3,745,865 | 7/1973 | Johnson | 74/69 |
| 3,791,227 | 2/1974 | Cherry | 74/52 |
| 3,884,050 | 5/1975 | Borcuk | 74/68 |
| 3,886,805 | 6/1975 | Koderman | 74/52 |
| 3,913,409 | 10/1975 | Opderbeck | 74/52 |
| 4,137,797 | 2/1979 | Brems | 74/52 |
| 4,236,416 | 2/1980 | Barcita | 74/52 |
| 4,300,271 | 11/1981 | Wohlhaupter | 403/381 |
| 4,371,362 | 2/1983 | Dorris | 403/381 |
| 4,876,992 | 10/1989 | McWhorter | 123/78 F |
| 5,158,046 | 10/1992 | Rucker | 123/197.4 |
| 5,158,047 | 10/1992 | Schaal et al. | 123/197.4 |
| 5,233,949 | 8/1993 | Rucker | 123/197.4 |
| 5,394,839 | 3/1995 | Haneda | 123/197.4 |

FOREIGN PATENT DOCUMENTS

| | | | |
|---|---|---|---|
| 829172 | 6/1938 | France | 74/52 |
| 3233314 | 3/1984 | Germany | 123/197.4 |
| 433008 | 4/1948 | Italy | 123/78 |
| 0058255 | 4/1984 | Japan | 74/52 |

*Primary Examiner*—Thomas E. Denion
*Attorney, Agent, or Firm*—Alfred Lei

[57] ABSTRACT

A cylinder having a piston assembly capable of stopping once when having moved up and down every time including a housing having a cavity, a gear ring fixedly within the cavity of the housing, a main crankshaft fitted within the cavity of the housing and provided with an eccentric recess, a gear meshed with said gear ring, an auxiliary crankshaft including an upper axle and a lower axle, the upper axle being connected with a piston assembly via connecting rod and having a center tangent to a pitch circle of the gear, the lower axle being pivotally connected with the eccentric recess of the main crankshaft, the gear meshed with the gear ring and fixedly mounted on the lower axle of the auxiliary crankshaft and having gear ratio of 2:3 to the gear ring.

2 Claims, 8 Drawing Sheets

CYLINDER HAVING A PISTON ASSEMBLY CAPABLE OF STOPPING ONCE WHEN HAVING MOVED UP AND DOWN EVERY TIME

BACKGROUND OF THE INVENTION

It is found that the volume efficiency of the prior art cylinder cannot be enhanced on account of insufficient intake air. Although it is proposed to open the valve earlier and delay the close thereof or use a turbo-charger to obviate the drawback, the function will still be limited and the cylinder cannot provide higher volume efficiency as the piston moves quickly and the time for intaking air is shortened.

Therefore, it is an object of the present invention to provide a cylinder which may obviate and mitigate the above-mentioned drawbacks.

SUMMARY OF THE INVENTION

This invention relates to a cylinder having a piston assembly which will stop once when moving up and down every time.

It is the primary object of the present invention to provide a cylinder which may increase the volume efficiency.

It is another object of the present invention to provide a cylinder which has sufficient intake air and cooling time even when the piston assembly quickly moves up and down.

It is still another object of the present invention to provide a cylinder having a piston assembly capable of stopping once when having moved up and down every time which is especially helpful for actuating a press or the like.

It is still another object of the present invention to provide a cylinder having a piston assembly capable of stopping once when having moved up and down every time which is simple in construction.

It is a further object of the present invention to provide a cylinder having a piston assembly capable of stopping once when having moved up and down every time which is practical in use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
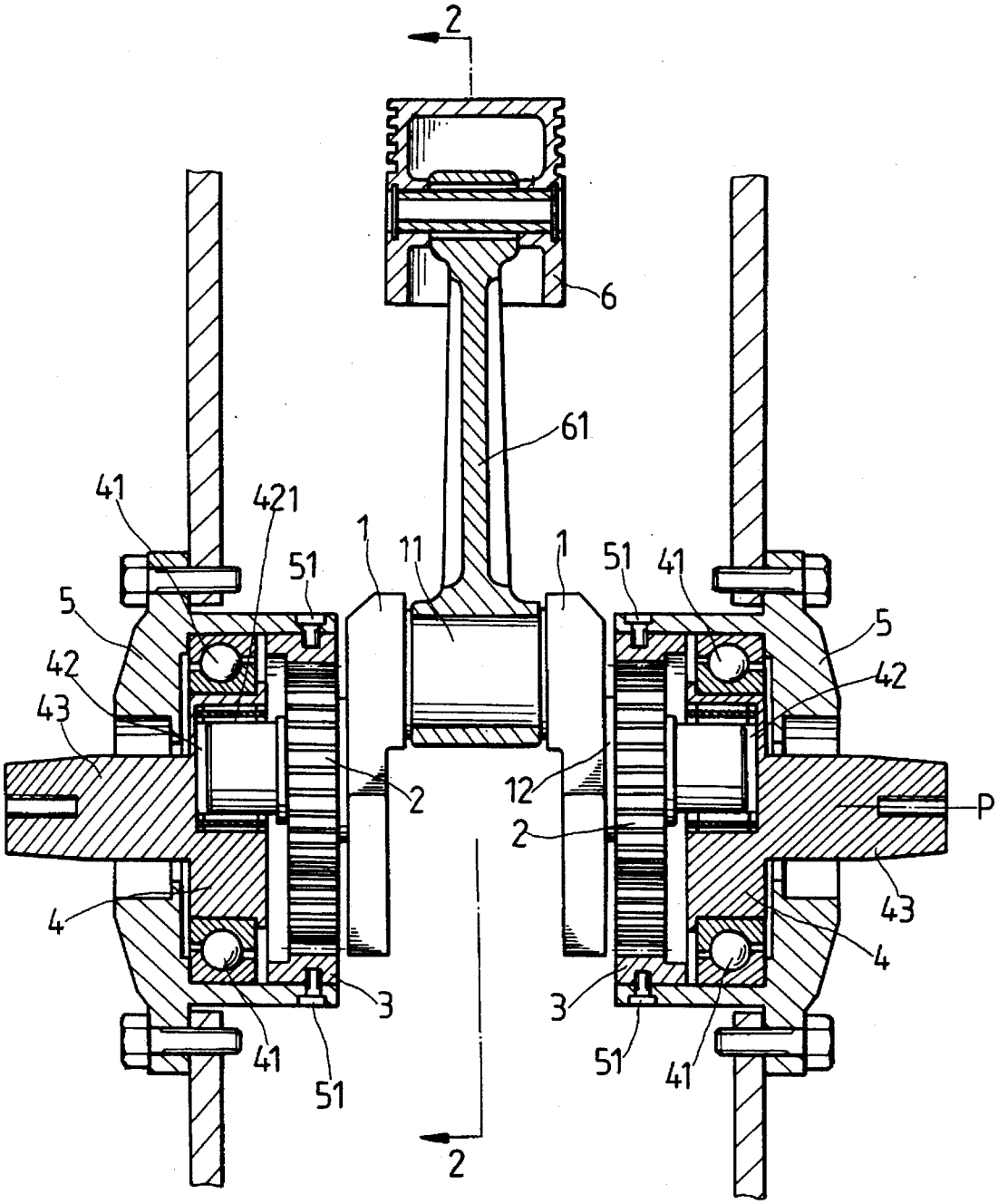
FIG. 1 is a sectional view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
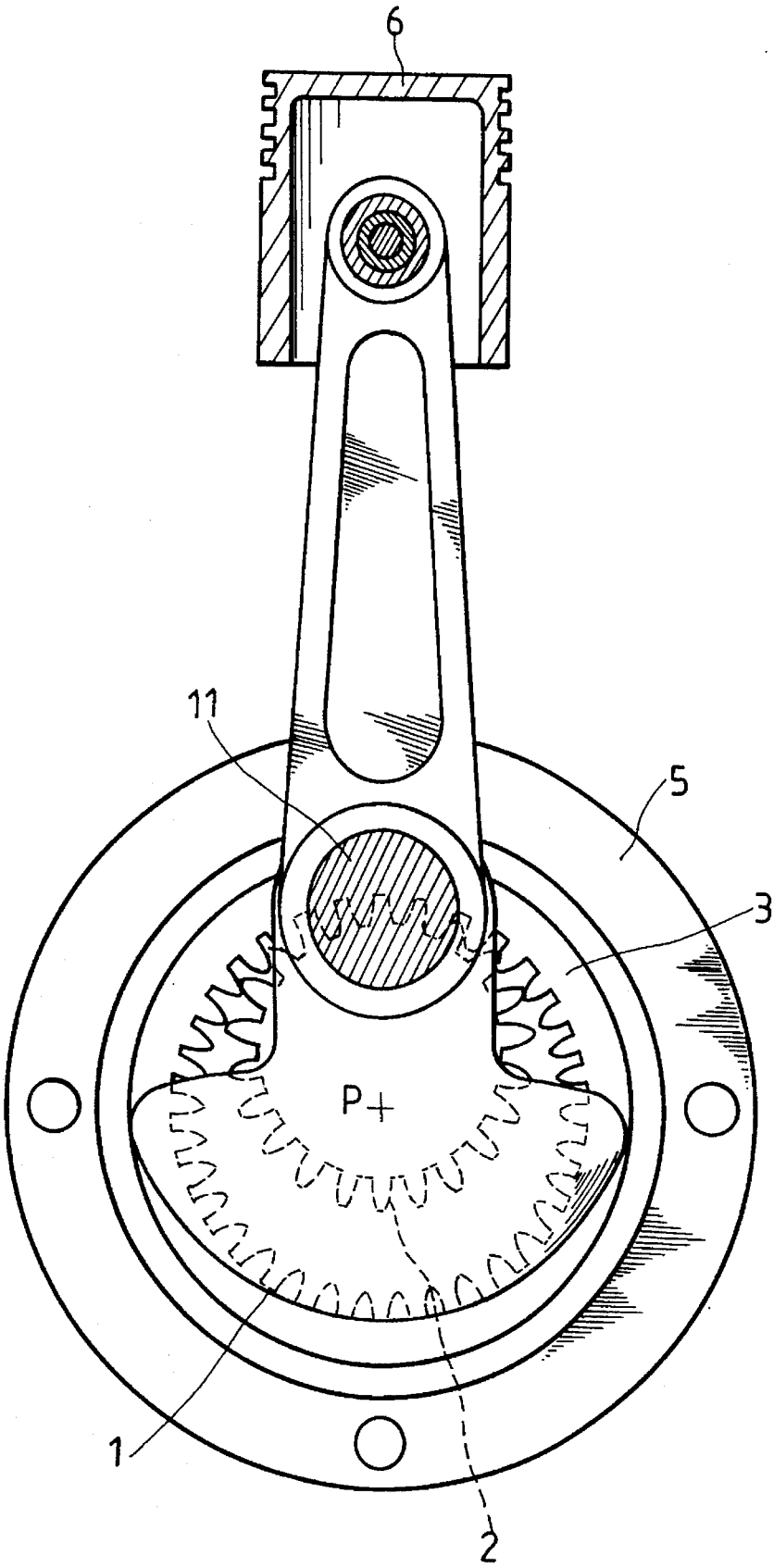
FIG. 2 is a sectional view taken along line 2—2 of FIG. 1.

With reference to the drawings and in particular to FIGS. 1 and 2 thereof, the present invention mainly comprises a main crankshaft 4, an auxiliary crankshaft 1, a gear 2, a gear ring 3, a housing 5, a piston assembly 6, and a connecting rod 61.

The auxiliary crankshaft 1 includes an upper axle 11 and a lower axle 12. The upper axle 11 is connected with the piston assembly 6 via a connecting rod 61. The gear 2 is fixedly mounted on the lower axle 12 of the auxiliary crankshaft 1. The upper axle 11 of the auxiliary crankshaft 1 has a center line tangent to the pitch circle of the gear 2.

The gear ring 3 is fixedly installed within a cavity of the housing 5 by screws 51 or the like. The gear 2 is engaged with the gear ring 3. The gear ratio of the gear 2 to the gear ring 3 is 2:3.

The main crankshaft 4 is fitted within the cavity of the housing 5 and supported by a bearing 41. The main crankshaft 4 is formed with an eccentric recess 42 in which is fitted a bearing 421. The lower axle 12 of the auxiliary crankshaft 1 is supported by the bearing 421.

Figure 3:
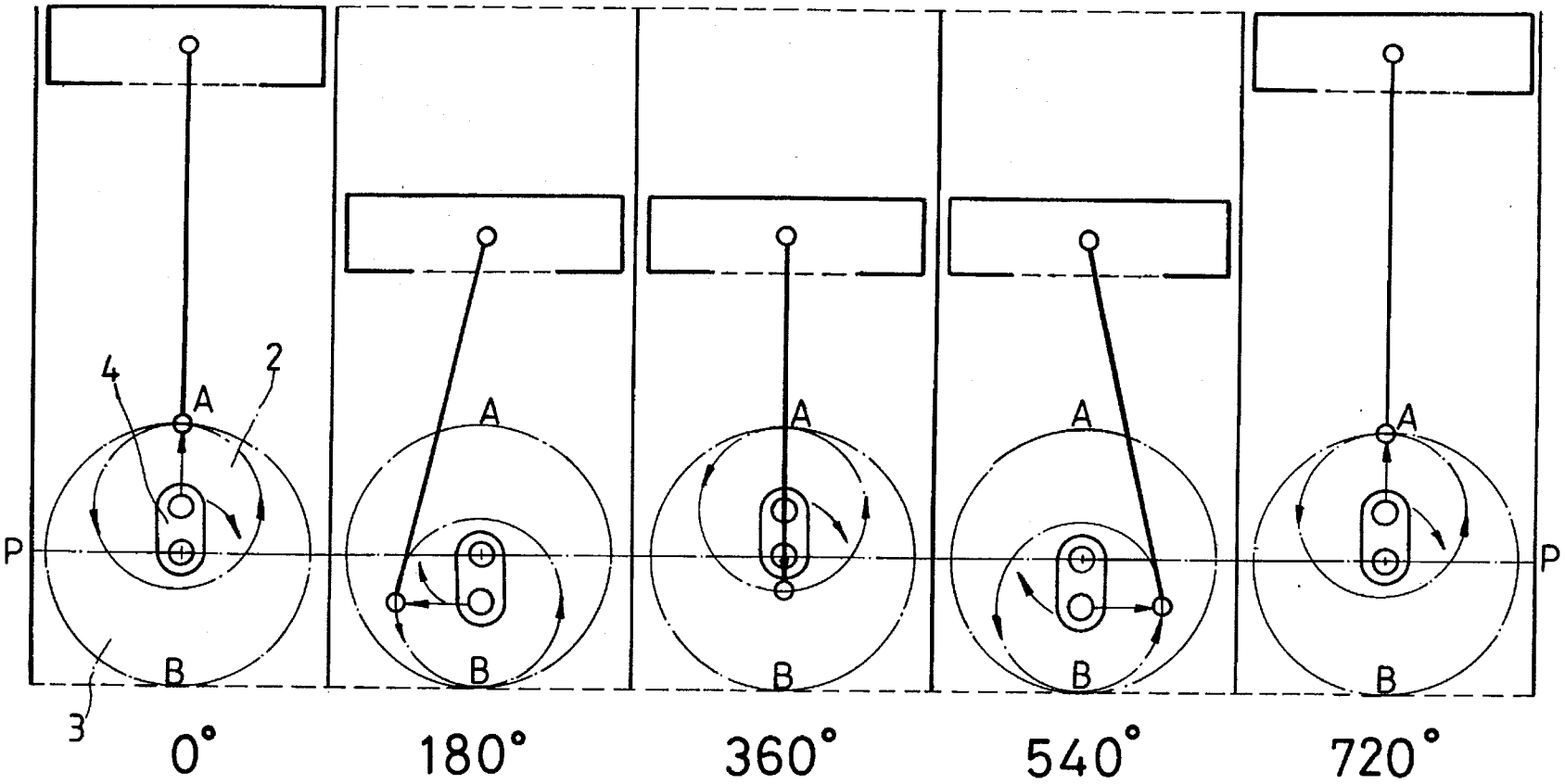
FIG. 3 shows the principle of the present invention.
Figure 4:
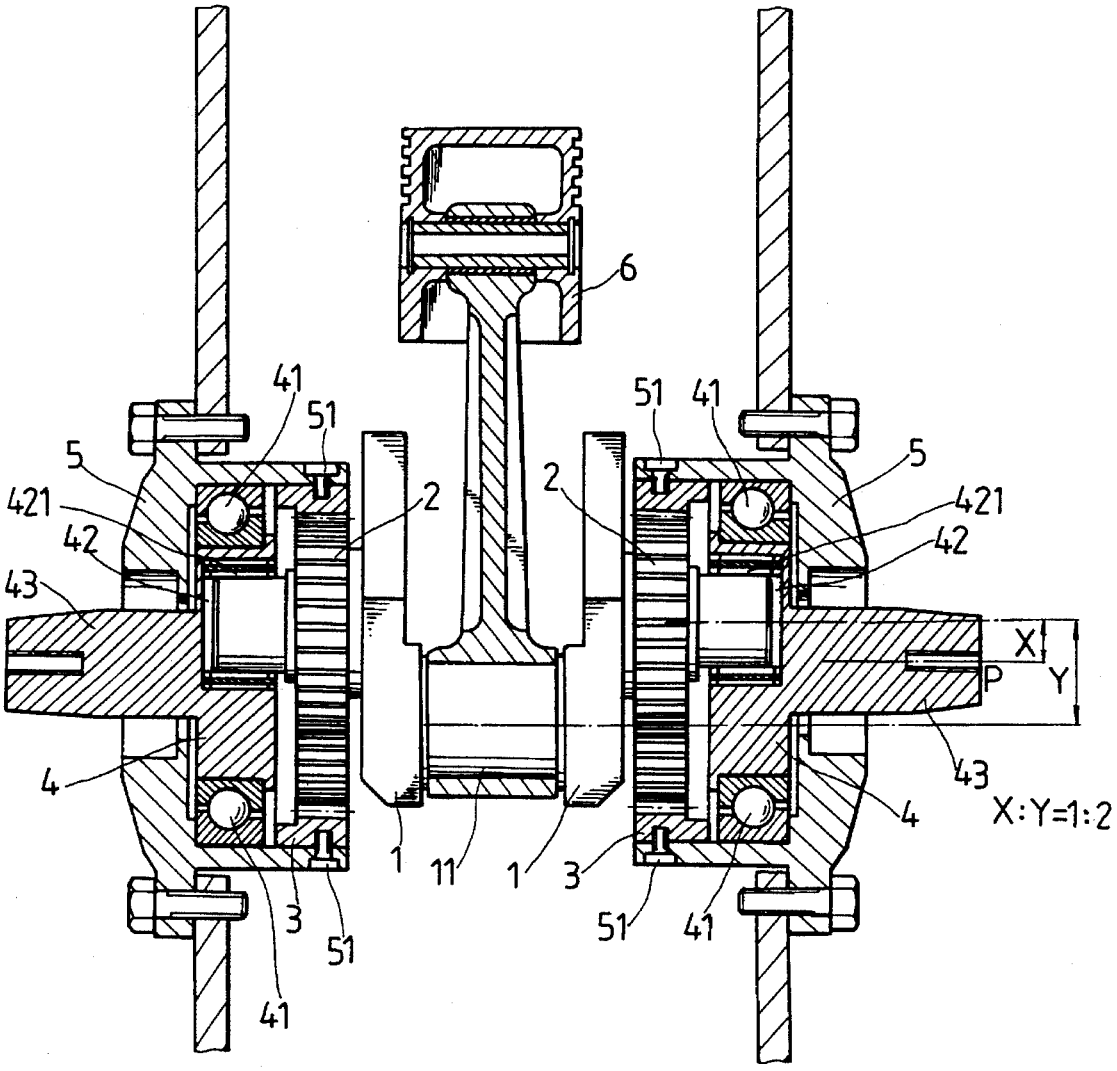
FIG.4 is a working view of the present invention.

Looking now at FIGS. 3 and 4, the rotating radius X of the main crankshaft 4 is just equal to one-half of the rotating radius Y of the auxiliary crankshaft 11. In addition, the center line of the upper axle 11 of the auxiliary crankshaft 1 is tangent to the pitch circle of the gear 2. Further, the lower axle 12 is concentric with the eccentric recess 42 of the main crankshaft 4. Moreover, the gear ratio of the gear 2 to the gear ring 3 is 2:3. Accordingly, when the gear 2 rotates through an angle of 180 degrees in clockwise direction (with respect to FIG. 3), the gear 2 will move from the highest point A to the lowest point B of the gear ring 3 while the auxiliary crankshaft 1 will rotate through an angle of 90 degrees in counterclockwise direction. As a result, the piston assembly 6 is moved downward. When the gear 2 rotates through an angle of 360 degrees (see FIGS. 3 and 4) in clockwise direction, the gear 2 will move from the lowest point B to the highest point A, the main crankshaft 4 will rotate through an angle of 360 degrees, and the auxiliary crankshaft 1 will rotate through an angle of 180 degrees in counterclockwise direction. Hence, the auxiliary crankshaft 1 will be moved to the lowest position, while the gear 2 will be moved upward, thereby keeping the piston assembly 6 at a fixed position. When the gear 2 rotates through an angle of 540 degrees in clockwise direction, the main crankshaft 4 will also rotate through an angle of 540 degrees. Meanwhile, the gear 2 will move from the highest point A to the lowest point B of the gear ring 3 and the auxiliary crankshaft 1 will rotate through an angle of 270 degrees in counterclockwise direction thereby further keeping the piston assembly 6 at a fixed position. When the gear 2 rotates through an angle of 720 degrees in clockwise direction, the main crankshaft 4 will also rotate through an angle of 720 degrees and the gear 2 will move from the highest point A to the lowest point B of the gear ring 3, and the auxiliary crankshaft 1 will rotate through an angle of 360 degrees in counterclockwise direction.

Hence, the piston assembly 6 will stop once after having moved up and down every time thereby enabling the cylinder to intake air and cool sufficiently and therefore increasing the volume efficiency. In addition, when the piston assembly 6 stays at the stop stroke, the gear 2 will still rotate without loading so that a large amount of energy will be stored in the piston assembly 6 which will increase the efficiency of the cylinder.

Figure 5:
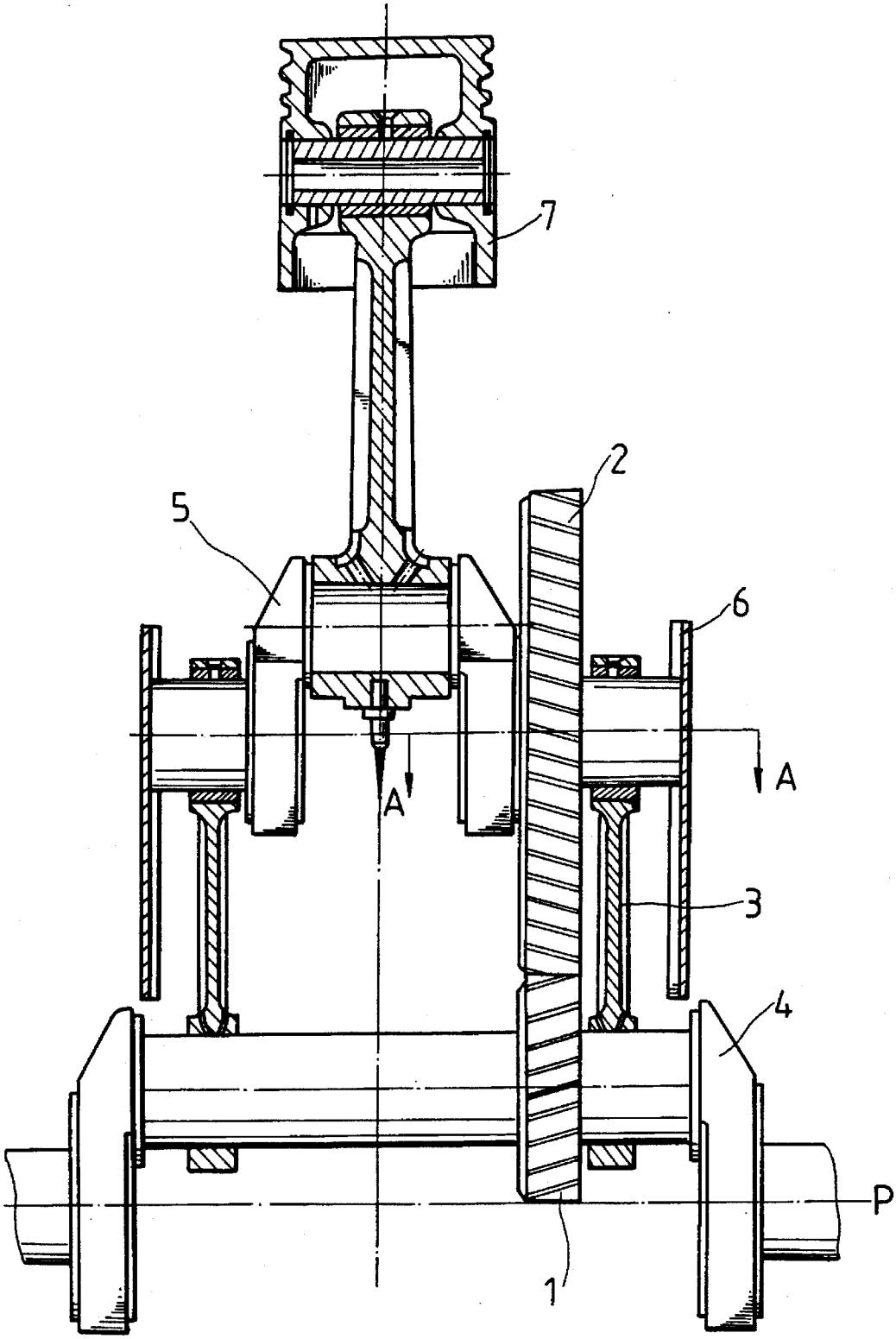
FIG. 5 is a sectional view of a second preferred embodiment according to the present invention.
Figure 6:
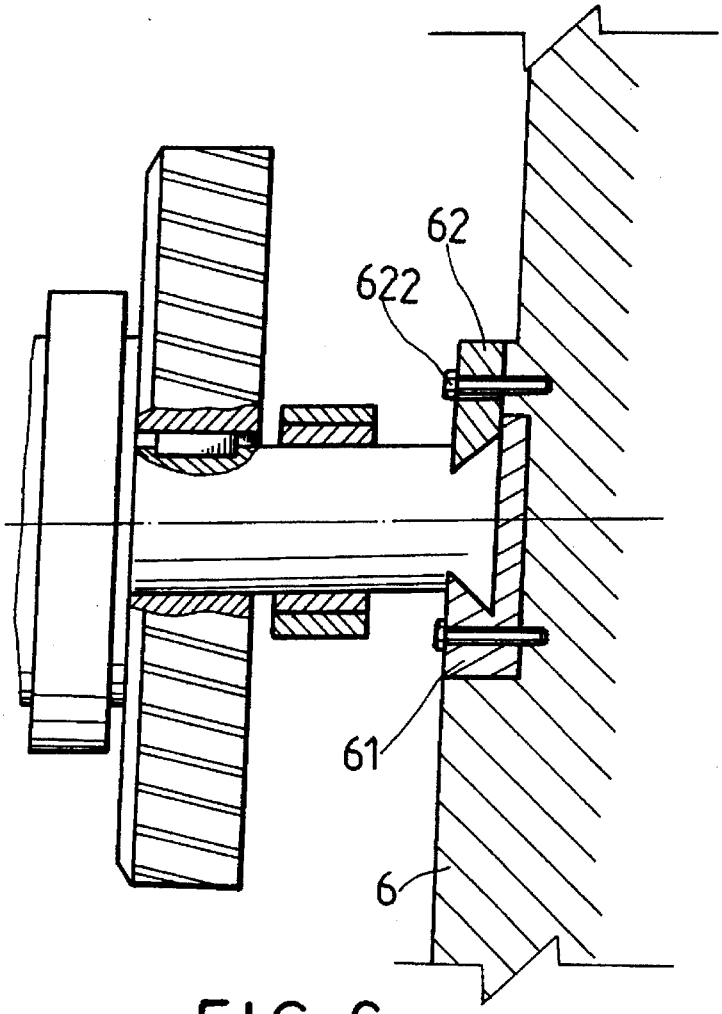
FIG. 6 is a sectional view of the guide plate of the second preferred embodiment.
Figure 7:
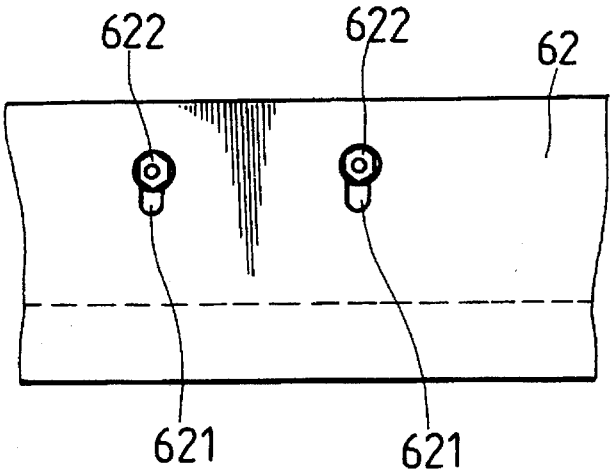
FIG. 7 is a fragmentary view of the guide plate of the second preferred embodiment.

FIG. 5 is a sectional view of a second preferred embodiment according to the present invention. As shown, the second preferred embodiment mainly comprises a pinion 1, a gear 2 with two times the diameter of the pinion 1, a linking rod 3, a main crankshaft 4, an auxiliary crankshaft 5, a dovetail guide plate 6, and a piston assembly 7. The pinion 1 and the gear 2 are respectively mounted on the auxiliary crankshaft 5 and the main crankshaft 4 and are separated by a fixed distance via the linking rod 3 so that the pinion 1 and the gear 2 are meshed together in rotation. The upper and lower ends of the linking rod 3 are respectively connected to the auxiliary crankshaft 5 and the main crankshaft 4 which is the driving axle. The auxiliary axle 5 is driven by the gear 2 and provided with two dovetail ends which is capable of moving vertically along the dovetail guide plate 6. The dovetail guide plate 6 (see FIGS. 6 and 7) is constituted by a base 61 and adjusting block 62 on which there is an elliptical threaded hole 621 utilizing a screw 622 to regulate the distance between the adjusting block 62 and the base 61. The piston assembly 7 is driven by the auxiliary crankshaft 5.

Figure 8:
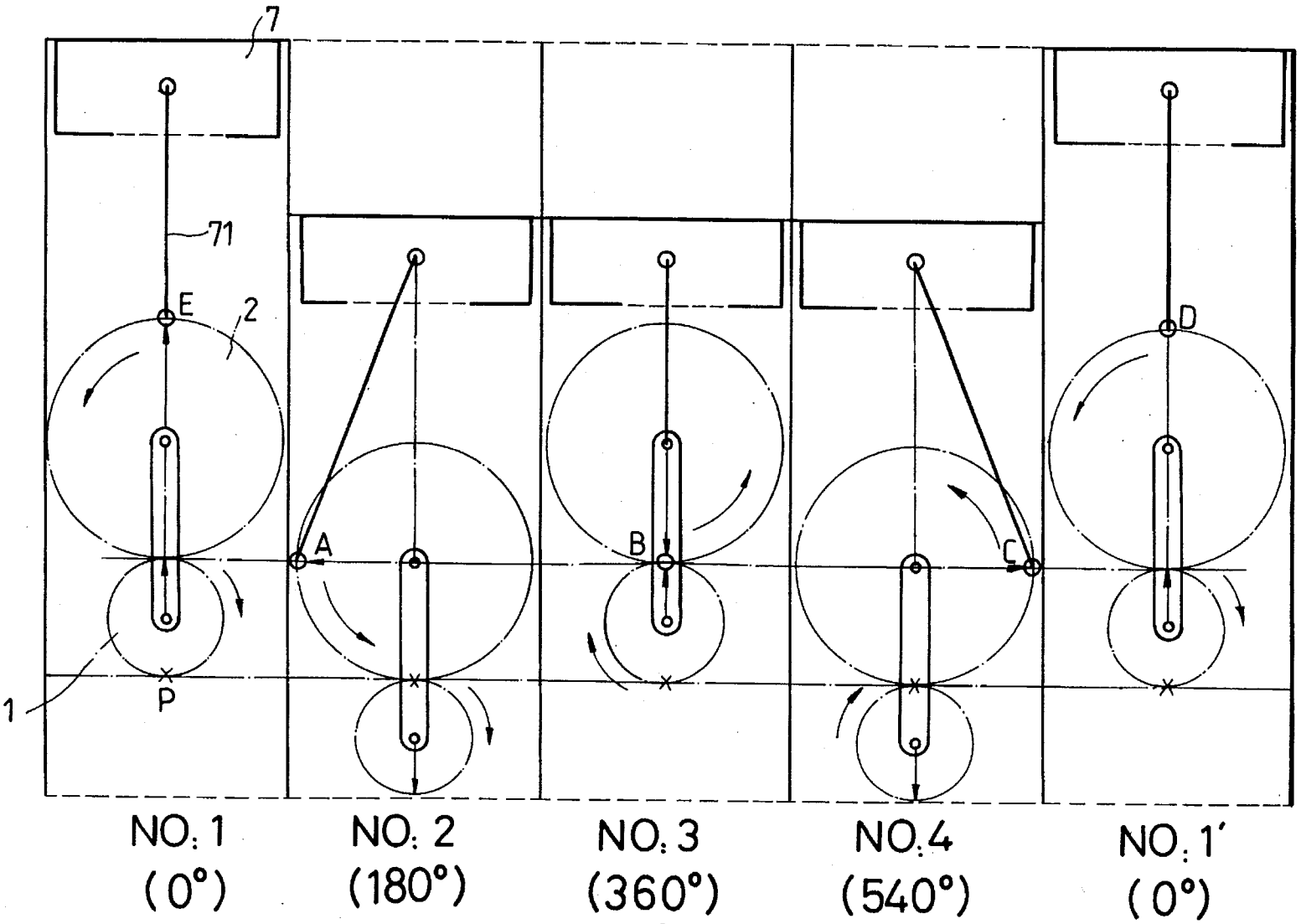
FIG. 8 shows the principle of the second preferred embodiment.
Figure 9:
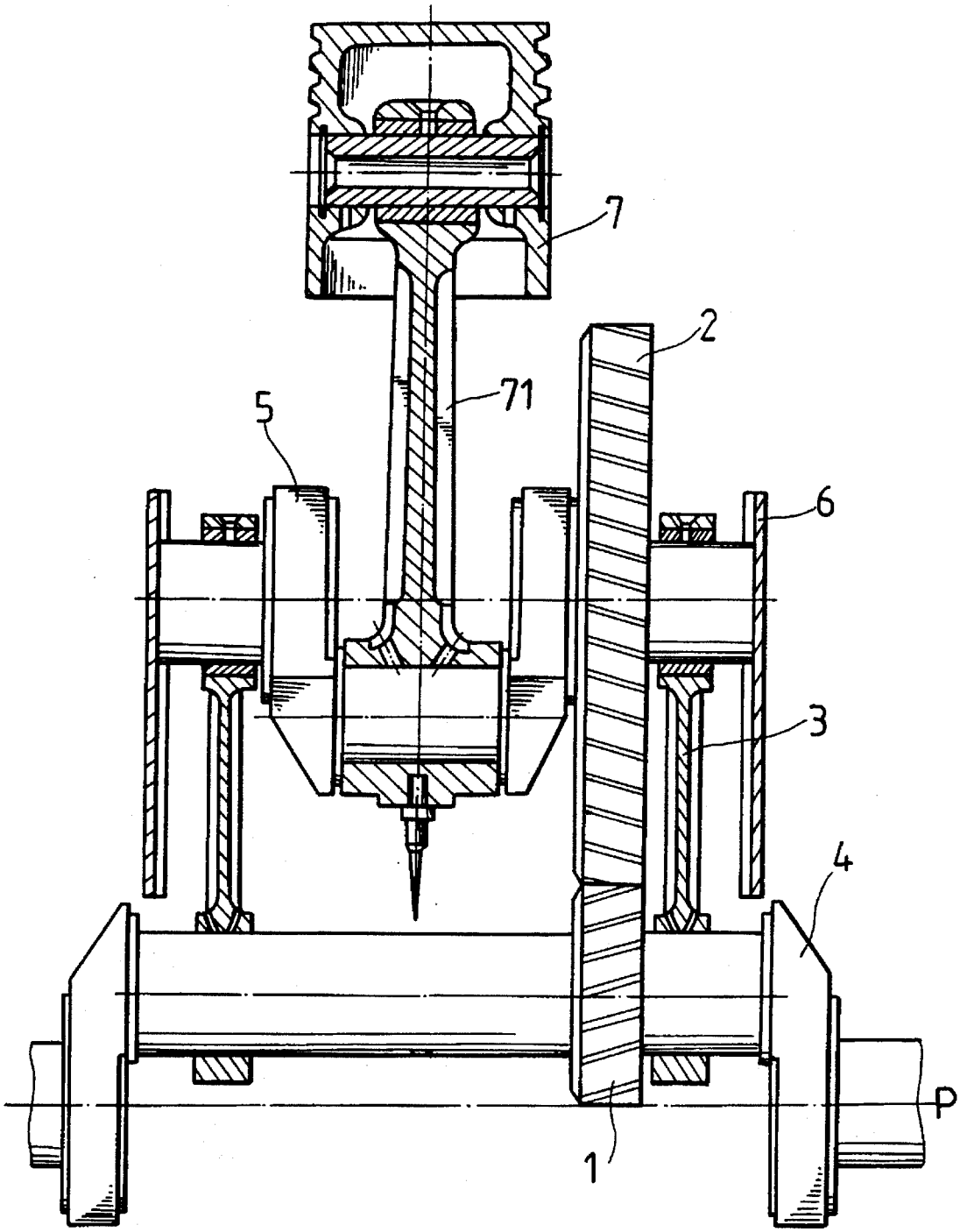
FIG. 9 is a working view of the second preferred embodiment.

When in use, the main crankshaft 4 drives the pinion 1 fixed thereon to rotate the gear 2 with respect to the point P. The gear 2 is fixedly connected with the auxiliary crankshaft 5 which is provided with two dovetail ends slidably fitted with the dovetail guide plate 6. Hence, the auxiliary crankshaft 5 may drive the piston assembly 7 to move up and down. Referring to FIG. 8, there is shown the connection between the gear 2, the pinion 1 and the piston assembly 7. As the piston assembly 7 is located at the uppermost position, the pinion 1 is set to be located at zero degree (see FIG. 5). Since the diameter of the gear 2 is two times the diameter of the pinion 1, the gear will rotate 90 degrees in counterclockwise direction when the pinion 1 rotates 180 degrees with respect to the point P in clockwise direction (see FIG. 8). Hence, if the pinion 1 has a diameter of 1 inch and the gear 2 has a diameter of two inches, then both of them will move one inch downwards and the piston assembly 7 will move two inches downwards. Meanwhile, the linking rod 71 rotates from point E to point A. As the pinion 1 further rotates to 360 degrees with respect to the point P in clockwise direction to raise 1 inch, the gear 2 will rotate to 180 degrees in counterwise direction to drive the piston assembly 7 via the auxiliary crankshaft 4 to move 1 inch downwards (see FIGS. 8 and 9). As a result, the linking rod 71 will move from point A to point B thereby moving the piston assembly 7 up and down and then returning it at the original position (see No. 3 in FIG. 8). When the pinion 1 further rotates to 540 degrees in clockwise direction, the pinion 1 will move 1 inch downwards while the gear 2 will move to 270 degrees in clockwise direction, the pinion 1 will move 1 inch downwards while the gear 2 will move to 270 degrees in counterclockwise direction thereby moving the piston assembly 7 to move 1 inch upwards and the linking rod 71 from pint B to point C. Hence, the piston assembly 7 will move up and down and then returns to its original position. When the pinion 2 rotates to 0 degree in clockwise direction (see No. 1 in FIG. 8), the pinion will move 1 inch upwards and the gear 2 will rotate to 360 degrees and move 1 inch upwards too thereby moving the linking rod 71 from point C to point D and therefore, causing the piston assembly 7 to move 2 inches upwards. Thus, the piston assembly 7 will stop for a time after having moved up and down once. FIG. 9 shows a working view of the second preferred embodiment.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A cylinder having a piston assembly capable of stopping once when having moved up and down every time comprising:

a housing having a cavity;

a gear ring fixedly within the cavity of said housing;

a main crankshaft fitted within the cavity of said housing and provided with an eccentric recess;

a gear meshed with said gear ring;

an auxiliary crankshaft including an upper axle and a lower axle, said upper axle being connected with the piston assembly via connecting rod and having a center tanget to a pitch circle of said gear, said lower axle being pivotally connected with the eccentric recess of said main crankshaft;

said gear meshed with said gear ring and fixedly mounted on the lower axle of said auxiliary crankshaft and having gear ratio of 2:3 to said gear ring.

2. A cylinder having a piston assembly capable of stopping once when having moved up and down every time comprising:

a pinion;

a gear;

a linking rod;

a main crankshaft;

an auxiliary crankshaft;

a dovetail guide plate;

wherein said pinion is rigidly fixed to said gear, said gear being mounted on said auxiliary crankshaft, said linking rod having two ends respectively connected with said main crankshaft and said auxiliary crankshaft so as to mesh said gear with said pinion, said main crankshaft being used for power input or power output, said auxiliary crankshaft being provided with two dovetail ends slidably connected with said dovetail guide plate, said dovetail guide plate being constituted by a base and an adjusting block which has a screw for adjusting distance between said dovetail end of said auxiliary crankshaft and said dovetail guide plate.

* * * * *